United States Patent [19]

Chambers

[11] Patent Number: 5,063,871

[45] Date of Patent: Nov. 12, 1991

[54] APPARATUS FOR HOLDING AND ROTATING AN OBJECT

[76] Inventor: Denis Chambers, 60 Huntingtower Road, Grantham, England, NG31 7AN

[21] Appl. No.: 476,584

[22] Filed: Feb. 7, 1990

[51] Int. Cl.[5] ..... B05C 13/02; B05C 17/08

[52] U.S. Cl. ..... 118/13; 118/500; 118/503; 118/504

[58] Field of Search ..... 118/500, 503, 504, 13; 33/21.1, 21.2, 21.4; 269/296, 63, 68

[56] References Cited

U.S. PATENT DOCUMENTS 3,358,644 12/1967 Greene ..... 118/503
3,848,564 11/1974 Kull ..... 33/21.1
3,988,834 11/1976 Anderson ..... 118/503
4,185,389 1/1980 Fudro ..... 33/21.1

FOREIGN PATENT DOCUMENTS 994095 8/1976 Canada ..... 118/503

*Primary Examiner*—Richard V. Fisher
*Assistant Examiner*—Brenda Lamb
*Attorney, Agent, or Firm*—Jones Askew & Lunsford

[57] ABSTRACT

Apparatus for holding an object, for example, an ovoid object such as an egg to enable a pattern to be applied to the object. The apparatus comprises holding means to hold the object for rotation about an axis thereof and rotating means to rotate the object about said axis. As the object is being rotated a pattern can be applied thereto.

8 Claims, 4 Drawing Sheets

APPARATUS FOR HOLDING AND ROTATING AN OBJECT

This invention relates to apparatus for holding an object and more particularly to apparatus for holding an object to enable a pattern to be applied to the object.

The art of painting eggs is well known and painted eggs can be bought as souvenirs. Painting an egg is an extremely delicate operation involving a great deal of manual dexterity and artistic skill.

In order to paint an egg, the painter has to apply a desired pattern to the egg manually using simply a pen and his artistic skill.

It is an object of this invention to provide apparatus that will obviate the need for a great deal of manual dexterity and artistic ability in applying a pattern to an object.

According to one aspect of this invention there is provided apparatus for holding an object to enable a pattern to be applied thereto, said apparatus comprising a rotating member to rotate the object, a reaction support means to provide a reaction support for the object whereby the object can be held between the reaction support means and the rotating member, a base member upon which the reaction support means and the rotating member are mounted, wherein .the apparatus comprises first and second template support members attached to the base member at opposed sides thereof, said template support member being adapted to support a template defining at least a portion of a pattern to be applied to the object.

Preferably the template support members comprise wall members pivotally attached to the base member.

The template support members may define elongate recesses adapted to receive respective opposed edges of the template such that the template can be slid along the recesses as desired, said recesses being shaped to conform substantially with the profile of the object presented thereto.

The edges of the template support members may be shaped to conform substantially with the profile of the object presented thereto.

An object engaging member may be connected to the rotating member for rotation therewith and resilient urging means may be provided for urging the object engaging member into engagement with the object.

The object engaging member may comprise a formation adapted to be received in a corresponding recess formed in the object. The formation may be substantially cuboid in configuration.

The rotating member may be provided with a plurality of evenly spaced notches and a notch engaging member may be provided to engage said notches to inhibit rotation of the rotating member.

According to another aspect of this invention there is provided egg decorating apparatus comprising a base member, a rotating member mounted on the base member, a reaction support means mounted on the base member for providing a reaction support for an egg held between the rotating member and the reaction support means whereby the egg can be rotated by the rotating member, and first and second template support members attached to the base member at either side thereof each of said template support members being provided with a template engaging formation shaped to conform substantially with the profile of the egg presented thereto and being adapted to engage a template defining at least a portion of a pattern to be applied to the egg.

This invention is particularly suitable for use with the generally spherical or ovoid objects, for example eggs.

Reference is now made to the accompanying drawings in which.

Figure 1:
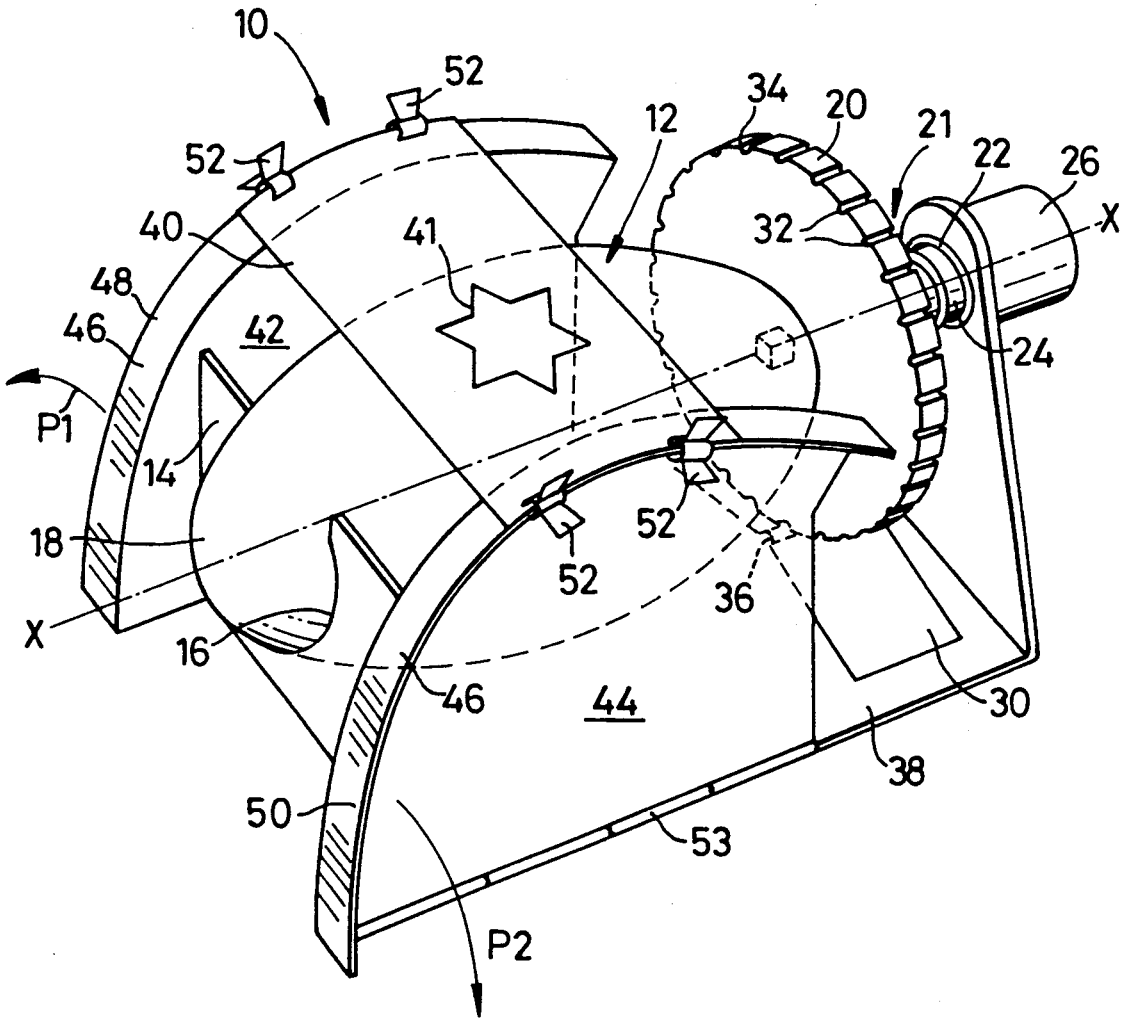
FIG. 1 is a perspective view of a first embodiment of the invention showing an egg held by the apparatus.

Referring to the drawings, apparatus for holding an object is shown, the apparatus being generally designated 10. Suitable objects to be held by the apparatus can be generally spherical objects such as an egg 12, for example a hens egg or a duck egg or an egg-shaped manufactured object.

The apparatus 10 generally comprises rotating means and holding means. The rotating means constitutes part of the holding means which also comprises a reaction support means whereby the egg 12 is held between the rotating means and the reaction support means.

In the first embodiment, shown in FIGS. 1 to 5, the rotating means comprises a wheel 20 and the reaction support means comprises support plate 14 defining a recess 16 which can receive an end portion 18 of the egg 12.

Attached to the wheel 20 is a resilient urging means 21 in the form of a spring 22 mounted on a shaft 24. The spring 22 and the shaft 24 can be received in a shaft receiving member 26 as will be explained below.

A carrying member 28 is provided to carry the shaft 24 and the spring 22 and thereby to support the wheel 20 and also to support the shaft receiving member 26.

The shaft receiving member 26 is disposed on the opposite side of the carrying member 28 to the wheel 20. An aperture in the carrying member 28 allows the shaft receiving member 26 to receive the shaft 24 and the spring 22.

Figure 2:
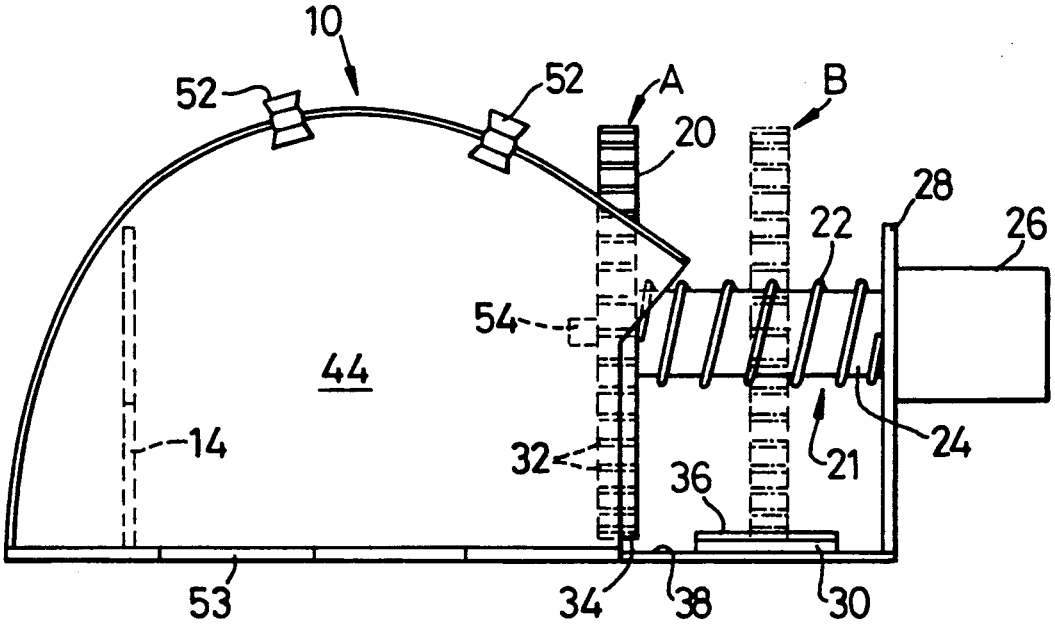
FIG. 2 is a side view of the first embodiment without the egg.
Figure 5:
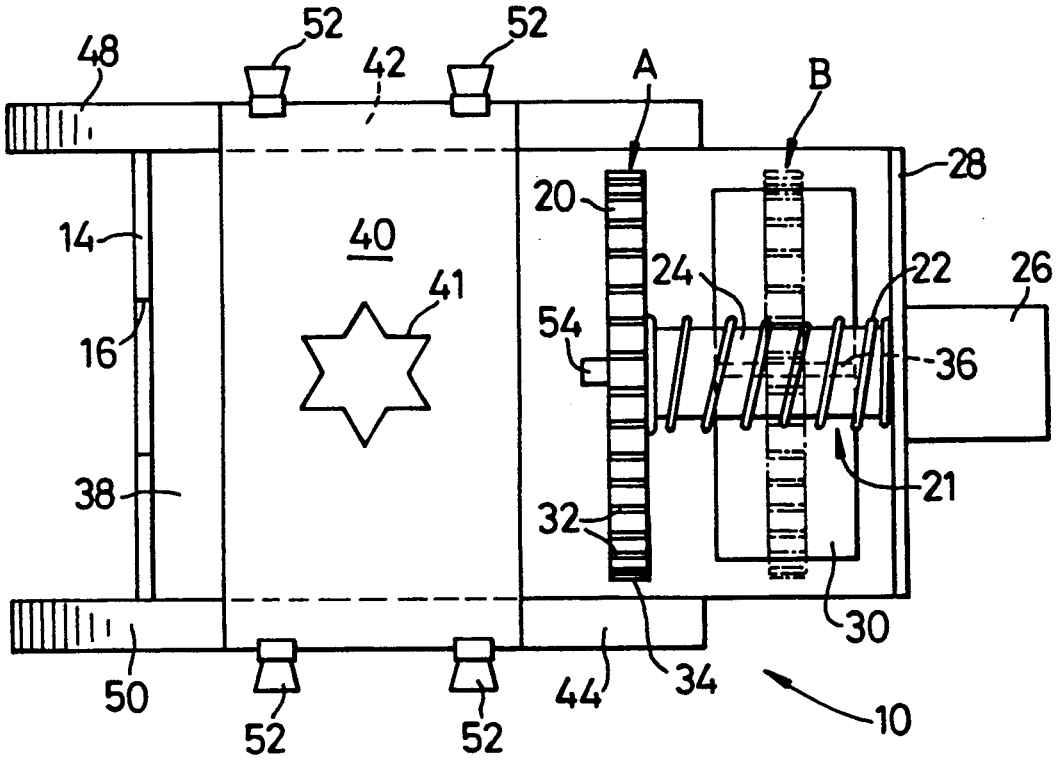
FIG. 5 is a plan view of the first embodiment without the egg.

The shaft receiving member 26 allows the wheel 20 to be retracted from a position at A shown in solid lines in FIGS. 2 and 5 to a retracted position at B shown in phantom lines in FIGS. 2 and 5.

At retracted position B as seen in FIGS. 2 and 5, the wheel 20 is in the same position as shown in Figure and the apparatus can thus receive the egg 12. The resilient urging means 21 urges the wheel 20 into engagement with the egg 12 so that the egg 12 can be rotated by the wheel 20 about an axis X—X of the egg 12.

When the wheel 20 is in position B, the wheel 20 is brought into engagement with detent means in the form of a leaf spring 30 which acts to inhibit rotation of the wheel 20.

The wheel 20 is provided with a plurality of notches 32 evenly spaced about the outer edge 34 thereof. In the embodiment shown there are twenty four notches 32. However, it will be appreciated that any other suitable number of notches can be provided.

When the wheel 20 is in position B the notches 32 engage a notch engaging member 36 on the leaf spring 30 whereby on rotation of the wheel 20 the notch engaging member 36 engages successive notches 32 thereby inhibiting rotation of the wheel 20. Also, when the notch engaging member 36 engages a notch 32 the wheel 20 is inhibited from rotation.

The apparatus 10 also comprises a base plate 38 attached to the support member 28 and to the support plate 14 which are disposed at substantially opposite ends of the base plate 38.

In order to apply a pattern to the egg 12 a template 40 can be provided having a portion 41 of the pattern cut therein. The template 40 is secured to the apparatus 10 by template engaging means in the form of wall members 42, 44 disposed at opposite sides of the base plate 38. Each of the wall members 42, 44 has a curved edge 46, as seen best in FIGS. 1 and 2. The curve of the edges 46 substantially matches that of the egg 12. Flanges 48, 50 are attached to the wall members 42, 44. The template 40 is secured to the flanges 48, 50 by means of suitable securing means 52, for example, clips.

The wall members 42, 44 are pivotally attached to the base plate 38 by pivots 53, only one of which is shown to enable the wall members 42, 44 to be pivotted about said pivot in direction indicated by arrows P1 and P2 to facilitate removal and replacement of the egg 12 in the apparatus 10.

The wheel 20 is also provided with an object engaging member 54 which can be in the form of a cooperating member adapted to be received in and to cooperate with a corresponding aperture in the egg 12 or to pierce the egg 12 to form the aperture. In the embodiment shown, the cooperating member 54 is a square member which protrudes from the wheel 20 at the centre thereof.

Alternative object engaging members 54 which would be suitable are a suction pad or both a suction pad and a square cooperating member.

The invention will now be described in operation. In order to dispose the egg 12 into the apparatus 10, the wheel 20 is moved from the position A to the retracted position B. The egg 12 is then disposed in the apparatus such that the end 18 of the egg 12 is received in the recess 16 in the support plate 14.

Figure 3:
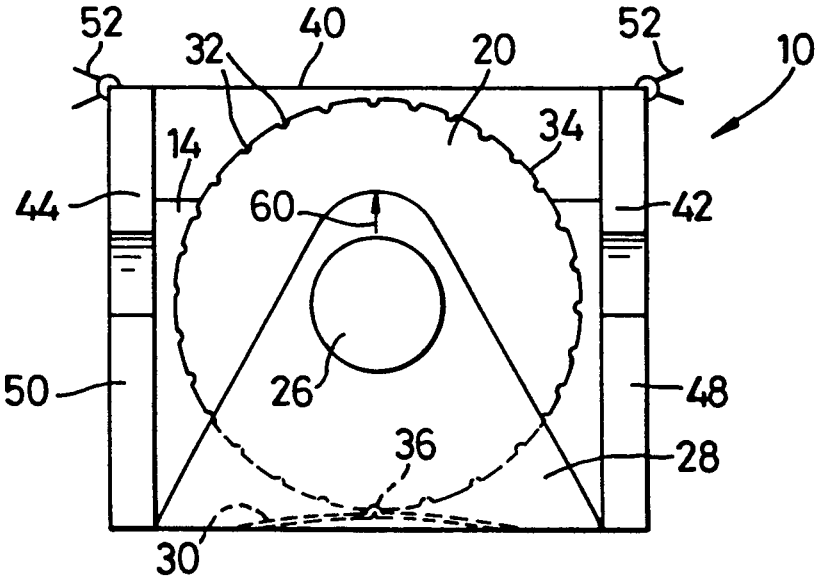
FIG. 3 is a rear view of the first embodiment without the egg.
Figure 4:
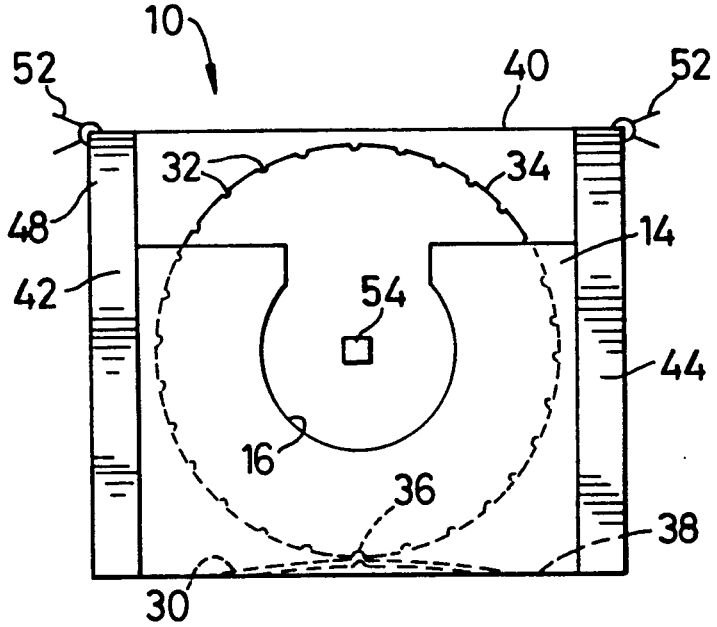
FIG. 4 is a front view of the first embodiment without the egg.

The wheel 20 can be provided with indicating means in the form of a pointer 60 (see FIG. 3). The wheel 20 can also be provided with a plurality of markers, for example, numerals disposed on the edge 34 adjacent to the notches 32. Thus the pointer 60 when used in conjunction with the numerals allows the wheel 20 to be rotated by a desired amount.

In order to hold the egg 12 in the apparatus 10, the resilient urging means 21 urges the wheel 20 towards and against the egg 12. The cooperating member 54 is then received by a recess in the egg 12 at the opposite end thereof to end 18. Thus, the egg 12 is held between the holding plate 14 and the wheel 20.

When the egg 12 is held between the holding plate 14 and the wheel 20, the template 40 can then be secured to the wall members 42, 44, by the securing means 52.

To apply the pattern to the egg 12, a pen or other suitable drawing implement is used to draw on the egg 12 around the outline of the portion 41 of the pattern cut into the template 40. The wheel 20 is then rotated by a desired amount so that the portion 41 of the pattern can be applied to the other part of the egg 12, the wheel 20 being inhibited from rotation by the engagement of the notch engaging member 36 in a corresponding notch 32 on the wheel 20. This can then be repeated until the egg 12 has been rotated through substantially 180°.

In order to apply the same pattern to a different part of the egg 12, the template 40 is moved along the wall members 42, 44. Alternatively, if it is desired to apply a different pattern to another part of the egg 12, a further template 40 can be used having cut therein a portion 41 of a different pattern.

To remove the egg 12 from the apparatus 10, the securing means 52 are released and the template 40 is removed. The wall members 42, 44 are then pivotted about their respective pivots 53 and the egg 12 can then be removed easily. When the egg 12 is removed, the wheel 20 returns to position A as shown in FIGS. 1 and 2 by the action of the urging means 21. Another egg 12 can then be disposed between the wheel 20 and the holding plate 14 and held thereby. The wall members 42, 44 are then pivotted to their upright position as shown in the drawings and the template is secured to the wall members 42, 44 by the securing means 52. The process for applying the pattern to the egg 12 can then be repeated.

Figure 6:
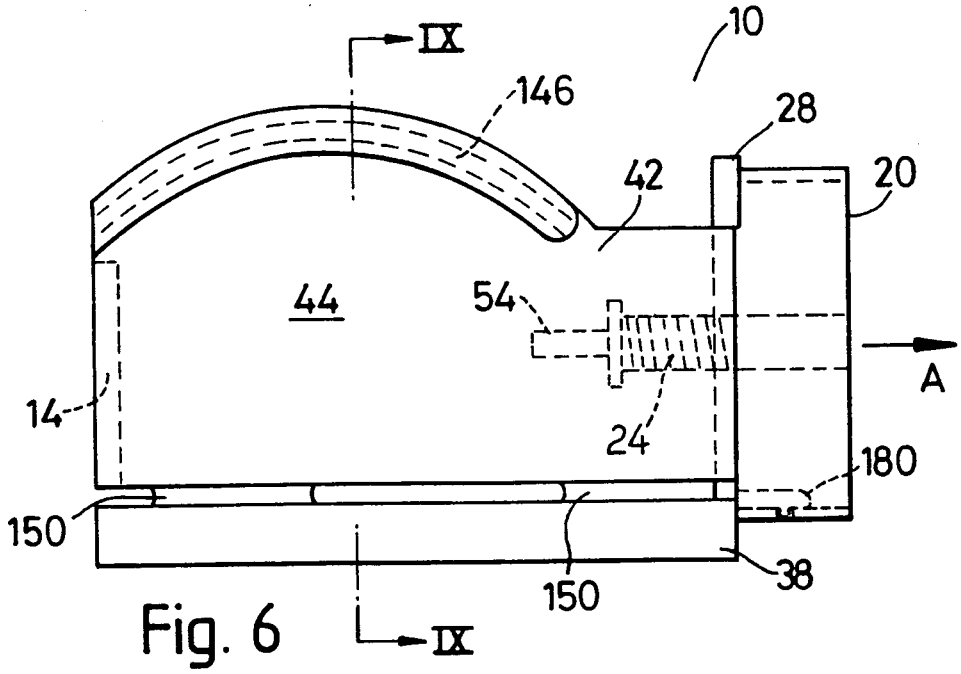
FIG. 6 shows a side view of a second embodiment of the invention.
Figure 7:
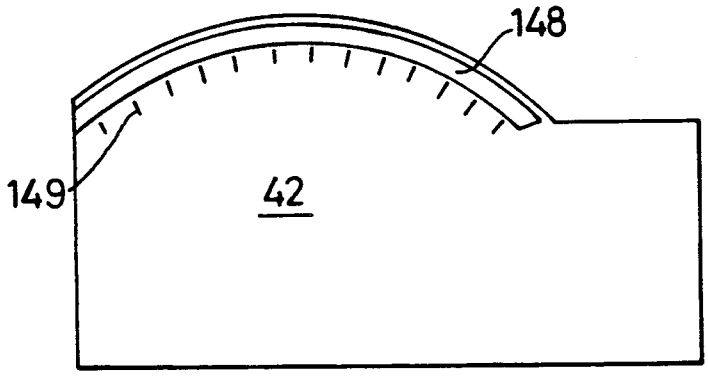
FIG. 7 shows a side view of a wall member according to the second embodiment.
Figure 8:
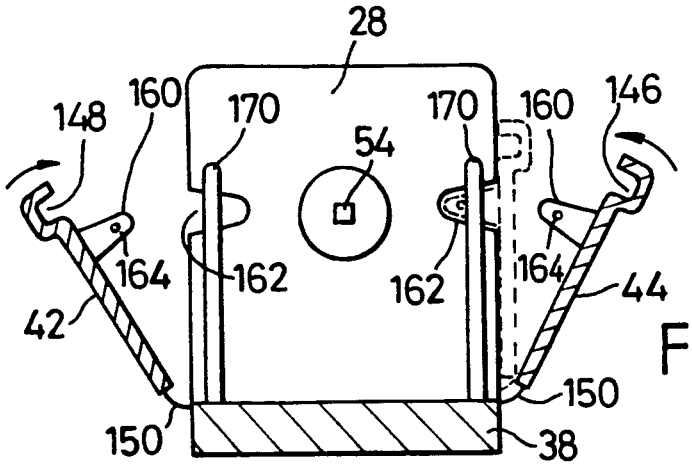
FIG. 8 is a view along the lines IX—IX of FIG. 6.

FIGS. 6 to 8 show a second embodiment of the invention which is similar to that shown in FIGS. 1 to 5. Those features which are found in the second embodiment shown in FIGS. 6 to 8 and in the first embodiment shown in FIGS. 1 to 5 are designated by the same numbers.

In the second embodiment the egg is held at one end by the support plate 14 which has a recess defined therein as in the first embodiment. At the other end, the egg is held by the object engaging member 54 in the form of a cuboid formation. The object engaging member 54 is received in a corresponding recess provided in the egg so that the egg can be held in the apparatus.

As with the first embodiment, the wheel 20 is retractable in the direction indicated by the arrow A and, therewith, the object engaging member 54 is also retractable to enable the egg to be removed or replaced in the apparatus.

In the second embodiment, the wall members 42,44 (only one wall member 44 is shown in FIG. 6) are attached to a base member 38 by integral hinges 150.

Referring now to FIG. 7, the wall member 42, which would be positioned behind the wall member 44 in the view of the third embodiment shown in FIG. 6, is provided with a recess 148 to receive an edge of a template (not shown in FIGS. 6 to 8). The wall member 44 is also provided with a corresponding recess 146 to receive the opposite edge of the template. In this way, the template can be held over the egg to enable the pattern to be applied thereto. Graduations 149 can be provided adjacent the recess to allow the template to be positioned accurately.

In order to maintain the wall members 42,44 in their upright position to support the template detent means 160 is provided on each wall member 42,44. The detent means 160 are in the form of formations on the wall members 42,44. The detents 160 can be received in corresponding recesses 162 provided in the carrying member 28.

The detents 160 are each provided with a projection 164 which projection 164 can snap into position as shown in phantom for wall member 44. Projection engaging members 170 are provided against which each projection 164 engages to maintain the wall members 42,44 in their upright position so that the wall members 42,44 can support the template.

In order to move the wall members 42,44 from their upright position, the carrying member 28 is deformed to enable each projection 164 to be disengaged from its respective projection engaging member 170 to enable each detent 160 to be removed from its respective recess 162.

A similar detent and recess arrangement is provided at the other end of each wall member, whereby the recesses are provided in the support plate 14. The arrangement here operates in the same way as described above.

The wheel 20 is provided with a plurality of notches on the inner surface thereof. A notch engaging member 180 is provided which engages the notches on the inside of the wheel 20 to inhibit rotation thereof.

I claim:

1. Apparatus for holding an egg-shaped object to enable a pattern to be applied thereto, said apparatus comprising:

a base;

a rotating member rotatably mounted on the base for rotation about an axis;

a reaction support means mounted on the base at a position axially spaced from the rotating member;

the rotating member and reaction support means co-operating to support an egg-shaped object therebetween for rotation about said axis;

first and second template support members attached to the base on opposite sides of said axis such that the template support members extend along opposite sides of an egg-shaped object when mounted between said rotating member and reaction support means;

the template support members each having a template support surface to enable a template to be supported at opposed ends to overlie an egg-shaped object mounted between said rotating member and reaction support means;

said rotating member comprising a hand wheel including a centrally located object-engaging member for drivingly connecting the wheel to the object;

the hand wheel being cooperable with a detent means for selectively hold the hand wheel at one of a plurality of radially defined positions; and the reaction support means comprising a plate member having a recess formed in its upper edge for rotatably receiving an end of the egg-shaped object.

2. Apparatus according to claim 1, wherein the template support members comprise wall members pivotably attached to the base member.

3. Apparatus according to claim 2, wherein the upper edge of each wall member defines said template support surface, said upper edge being curved to conform substantially with the profile of the egg-shaped object.

4. Apparatus according to claim 1, wherein the template support surface for each template support member comprises an elongate recess operative to receive a respective opposed edge of the template such that the template can be slid along the recesses as desired, said recesses being curved to conform substantially with the profile of the egg-shaped object.

5. Apparatus according to claim 1, wherein the hand wheel is axially movable and biased toward said reaction support means, and resilient urging means being provided for creating said bias for urging the object engaging member into engagement with the object.

6. Apparatus according to claim 1, wherein the object engaging member comprises a formation operative to be received in a corresponding recess formed in the object.

7. Apparatus according to claim 6, wherein the formation is substantially cuboid in configuration.

8. Apparatus according to claim 1, wherein the hand wheel is provided with a plurality of evenly spaced notches about its periphery, the detent means comprising a leaf spring mounted on the base and having a notch engaging member to engage said notches to inhibit rotation of the hand wheel.

* * * * *